United States Patent [19]

Anders

[11] Patent Number: 4,561,539

[45] Date of Patent: Dec. 31, 1985

[54] CLAMPING DEVICE FOR LONG TROUSERS, PARTICULARLY IN SUITCASES

[76] Inventor: Peter Anders, Ahornallee 47, D-1000 Berlin 19, Fed. Rep. of Germany

[21] Appl. No.: 673,702

[22] PCT Filed: Feb. 16, 1984

[86] PCT No.: PCT/DE84/00037

§ 371 Date: Oct. 18, 1984

§ 102(e) Date: Oct. 18, 1984

[87] PCT Pub. No.: WO84/03207

PCT Pub. Date: Aug. 30, 1984

[30] Foreign Application Priority Data

Feb. 28, 1983 [DE] Fed. Rep. of Germany ..... 3307399

[51] Int. Cl.[4] ..... A24F 15/00; B65D 85/18

[52] U.S. Cl. ..... 206/279; 206/289; 206/292

[58] Field of Search ..... 206/284, 289, 292, 278, 206/279, 284

[56] References Cited

U.S. PATENT DOCUMENTS

| | | | |
|---|---|---|---|
| 1,436,714 | 11/1922 | Hoerning . | |
| 1,811,035 | 6/1931 | Walinsky . | |
| 1,919,082 | 7/1933 | Wheary | 206/289 |
| 1,960,480 | 5/1934 | Danielsen . | |
| 2,080,645 | 5/1937 | Wheary | 206/279 |
| 2,278,935 | 4/1942 | Levine | 206/289 |
| 2,422,511 | 6/1947 | Wolsey . | |
| 2,526,385 | 10/1950 | Meyer | 206/289 |
| 2,796,961 | 6/1957 | Koch | 206/289 |
| 3,967,708 | 7/1976 | Gregg et al. | 206/279 |

FOREIGN PATENT DOCUMENTS

| | | |
|---|---|---|
| 135835 | 12/1933 | Fed. Rep. of Germany . |
| 513211 | 2/1921 | France . |
| 913728 | 9/1946 | France . |

*Primary Examiner*—Joseph Man-Fu Moy

[57] ABSTRACT

The invention relates to a clamping device for long trousers, particularly in suitcases, with which rapid and secure clamping of long trousers and their crease-free transport are ensured. The clamping device comprises a hinged base plate with an elbow having a buffer and with two vertical spaced-apart hangers which are movable with the elbows relative to the buffer in guide bearings secured on the base plate. Further, a pressure block is provided with a flexible buffer disposed opposite the buffer, the flexible buffer being movable with locking mechanisms on rails toward the elbow of the base plate. A guide frame disposed between the hangers may be swung from a position in the plane of the base plate into a position vertical to the latter and receives a tension bracket which is movable toward the base plate in order to clamp the length of a pair of trousers placed between the hangers and whose waistband and legs are clamped fast between the buffers.

12 Claims, 4 Drawing Figures

CLAMPING DEVICE FOR LONG TROUSERS, PARTICULARLY IN SUITCASES

The invention relates to a clamping device for long trousers, particularly in suitcases.

To transport trousers, for example in suitcases, without creasing them, it is known to equip suitcases with straps in which the folded trousers are to be secured against slipping. Also known are clothes hangers which are suspended in suitcases and clamp the trousers at the leg ends and/or at the waistline. These known devices are proving to have the disadvantage that, when the suitcase is tipped or thrown, the clamped or suspended long trousers may become displaced and thus, depending on the dexterity of the person packing the suitcase, are to a greater or lesser degree exposed to the danger of creasing.

The underlying object of the invention is to construct a clamping device for long trousers, particularly in suitcases, in such a manner that the long trousers to be transported are transported in firmly clamped and crease-free condition.

This object is achieved by the features recited in the characterizing part of patent claim 1.

Further advantageous developments of the clamping device in accordance with the invention appear in the sub-claims.

The clamping device in accordance with the invention realizes in a suitable manner quick and secure clamping of long trousers and their transport in uncreased condition.

The clamping device in accordance with the invention is described in connection with the drawings, in which.

Figure 1:
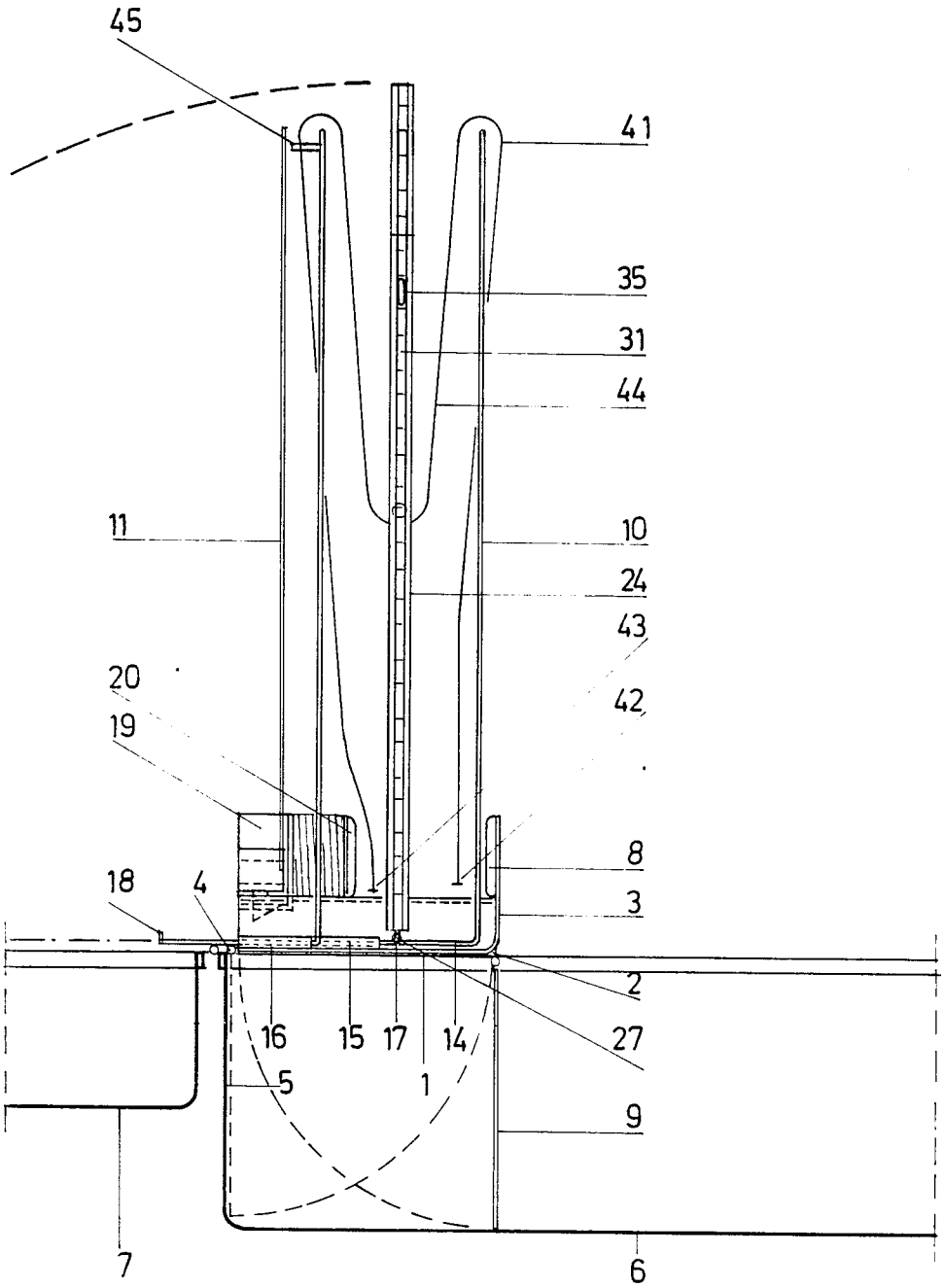
FIG. 1 is a side view of a preferred embodiment of the clamping device in accordance with the invention, with the base plate hinged to the inner bottom of a suitcase and with long trousers placed over the hangers.
Figure 2:
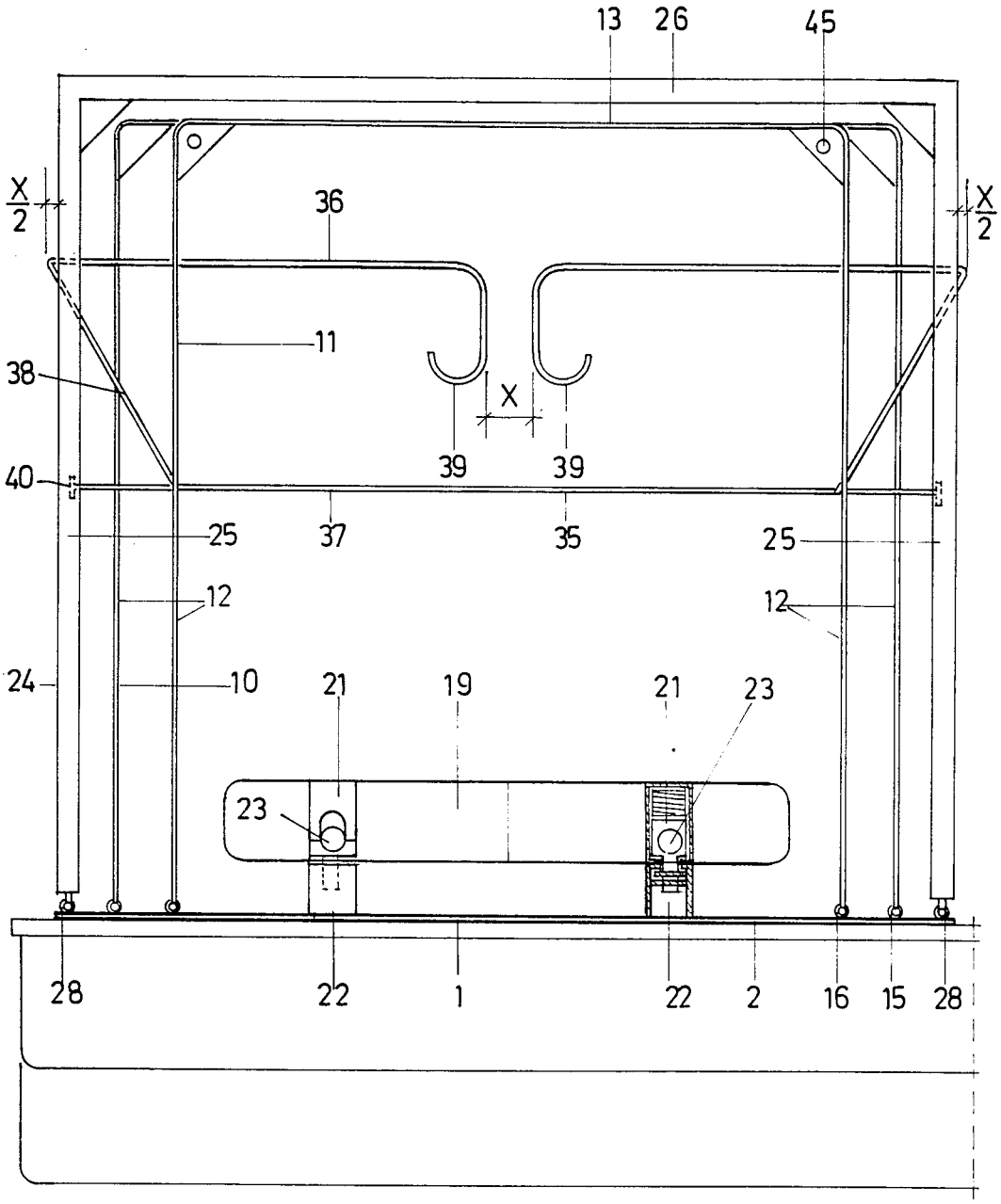
FIG. 2 is a front view of the clamping device of the invention according to FIG. 1.

As will be seen in FIGS. 1 and 2 showing a preferred embodiment of the clamping device, a base plate 1 with an elbow 3 pointing upwardly at right angles on a longitudinal edge 2 is releasably secured by means of a releasable hinge 4 to the inner bottom 5 of a suitcase 6 whose lid 7 is in FIG. 1 lifted up toward the left. A buffer 8 is provided on the inside of the elbow 3 of the base plate 1. In its horizontal position shown in FIG. 1, the base plate 1 is supported by a swing-out leg 9. After the leg 9 has been retracted, as indicated by the broken-line curve, the base plate 1 may be turned about the hinge 4 into the inside of the lower part of the suitcase.

On the base plate 1, hangers 10 and 11 of different widths (FIG. 2) are disposed spaced from each other and parallel to the longitudinal edges 2 of the base plate 1, the width of the hanger 10 closest to the elbow 3 of the base plate 1 being greater than the width of the other hanger 11. The hangers 10 and 11 have, respectively, round stock rods 12 vertical in relation to the base plate 1 and connected at their upper end by a round stock rod 13 extending parallel to the base plate 1. At the lower ends, the hangers 10 and 11 pass over, respectively, into a round stock elbow 14 parallel to the base plate 1, which are movably guided in bearings 15 and 16, respectively, extending parallel to the side edges 17 of the base plate 1. The guide bearings 15 associated with the hanger 10 closest to the elbow 3 of the base plate 1 are of a length at least one-half of the width of the base plate 1, in order that the hanger 10 may not slide out of the bearings 15 when it is pushed toward the buffer 8. The bearings 16 of the other hanger 11 are of a length which corresponds to one-quarter to one-third of the length of the length of the width of the base plate 1. Limit stop elements 18 may be provided on the free ends of the elbows 14. The height of the hangers 10 and 11 is lower than the available interior height of the lower part of the suitcase. The height of the two hangers 10 and 11 is substantially identical. The bearings 15 for the hanger 10 are secured on the base plate 1 closer to the elbow 3 of the base plate 1 than the bearings 16 of the hanger 11.

A pressure block 19 equipped with a flexible buffer 20 disposed opposite the buffer 8 of the elbow 3 of the base plate 1 is, as best shown in FIG. 1, secured to two locking mechanisms 21 which are adjustably guided in relation to the elbow 3 of the base plate 1 on a rail 22, respectively, parallel to the side edges 17 of the base plate 1 and mounted on the latter. The width of the buffer 20 is the same as that of the pressure block 19. Lock bolts 23 which are provided on the underside with a bevel rising toward the buffer 8 lock in slots disposed closely spaced in the rails 22. In dependence on the closeness of the slots in the rails 22, corresponding pressure can be achieved between the buffer 20 of the pressure block 19 and the buffer 8 on the elbow 3 of the base plate. The block 19 can be moved back only when the locking mechanisms 21 are released by pulling the locking bolts 23 which are urged downwardly by springs.

Figures 3, 4:
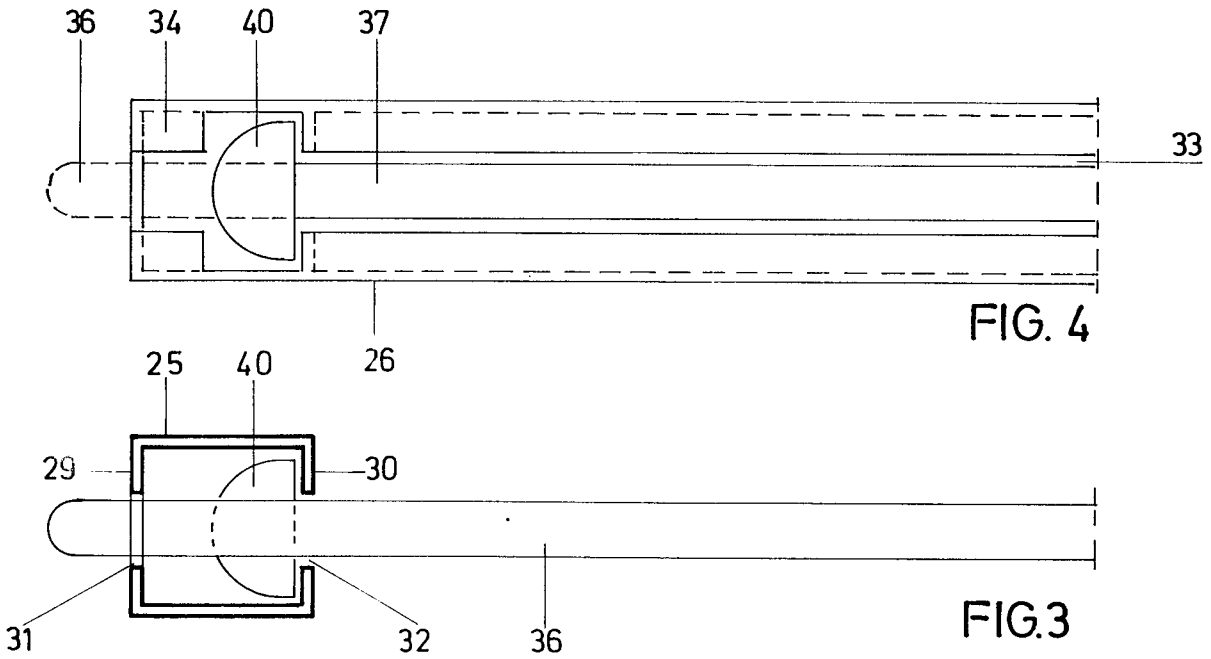
FIG. 3 is a top view onto a section through a vertical leg of the guide frame showing a tension bracket gripping through slots in the leg.
FIG. 4 is a top view onto the cross connection of the legs of the guide frame showing a tension bracket introduced into the guide frame.

A guide frame 24 is hinged to the base plate 1 between the hangers 10 and 11, its width and height being greater than those of the hangers 10 and 11 and smaller than the available suitcase height. The guide frame is swingable from a position in the plane of the base plate 1 into a position vertical to the latter and to the hangers 10 and 11 (compare FIG. 1, broken-line curve to the left). The frame 24 has two legs 25 which, when the frame is in upright position, stand vertically on the base plate 1 and are interconnected at their upper ends by a cross connection 26. The legs 25 and the cross connection 26 are made of square tubing. At the lower ends of the vertical legs 25 of the frame 24, elbows 27 parallel to the base plate 1 are provided which are made of round stock and are movable in guide bearings 28 mounted on the base plate 1 at the same distance from the elbow 3 as the guide bearing 16 of the hanger 11. The length of the bearings 28 is at least equal to one-half the width of the base plate 1. On the outer and inner sides 29 and 30, respectively, of the legs 25 of the guide frame 24, closely spaced oblong slots 31 and passing slots 32, respectively, are provided (FIG. 3). The cross connection 26 is formed of two juxtaposed spaced-apart U-profiles and is provided with passing oblong slots 33 above as well as below. As clearly shown in FIG. 4, recesses 34 are provided at the ends of the oblong slots 33.

A releasable trapeze-shaped tension bracket 35 is displaceably mounted in the guide frame 24. The tension bracket 35 has two bars 36 and 37 parallel to the base plate 1 as well as two lateral bars 38 connecting the bars 36 and 37 and inclined inwardly at an angle of about 60°. The cross-section of all the bars 36, 37, 38 of the tension bracket 35 is less than the width of the oblong slots 33 of the cross connection 26 of the guide frame 24. The upper bar 36 is divided in the center, and downwardly shaped grips 39 are disposed at a distance x from each other on the inner end of each half. When the tension bracket 35 is inserted into the frame 24 (compare FIG. 2), the upper bar 36 is by $=x/2$ wider on each side than the outer width of the guide frame 24. The lower bar 37 of the tension bracket 35 is of a length obtaining from the size of the inner width between the legs 25 of the frame 24 plus twice the thickness of the material of which the legs 25 are made.

The lower bar 37 of the tension bracket is provided at both ends with disk-like or spheroidal extensions 40 (FIG. 3) whose diameter is larger than that of the slots 32 in the legs 25 of the frame 24. The tension bracket 35 may also merely comprise a rod to be tightened with straps held in loops provided on the base plate.

Clamping of one or several pairs of long trousers 41 with the clamping device proceeds as follows:

First, the frame 24 is tilted by 90° about its knee joint toward the open suitcase lid 7 into the plane of the base plate 1. The trousers 41 are then placed over the hangers 10 and 11, so that the waistband 42 of the trousers 41 comes to lie on the hanger 10 which is urged toward the buffer 8, the waistband reaching down to the base plate 1, and so that the trouser legs 43 come to lie on the side of the hanger 11. The trouser legs 43 should be placed so that they also reach down to the base plate 1 and lie before the hanger 11 when the hanger 11 is urged to the side of the pressure block 19. By displacing the pressure block 19 by means of the locking mechanisms 21, the trouser legs 43 and the waistband 42 are clamped between the buffers 8 and 20. The excess length 44 of the trousers then hangs loosely in the middle between the two hangers 10 and 11.

The guide frame 24 is now swung into its position vertical to the base plate 1 between the hangers 10 and 11, and the tension bracket 35 is introduced into the guide frame from above and urged downward. In this position, the two outer ends of the upper bar 36 of the tension bracket 35 lock into the oblong slots 31 of the vertical legs 25 of the frame 24, and the tension bracket 35 can thereby be pulled upward.

A spacer 45 is mounted respectively to the right and left on top of the hanger 11 (FIG. 2) farthest removed from the elbow 3 of the base plate and points in direction of the pressure block 10. A stiff cover may be placed on the spacers 45, and clothing and other objects may then be packed into the suitcase on top of the cover without interfereing with the clamped trousers.

I claim:

1. Clamping device for long trousers, particularly in suitcases, characterized by:

(a) a base plate (1) with an elbow (3) pointing upward at right angles on a longitudinal edge (2), a buffer (8) being provided on the inside of the elbow (3), (b) hangers (10 and 11) of different widths disposed on the base plate (1) spaced apart and parallel to the longitudinal edges (2) of the base plate (1), and movable in relation to the elbow (3), (c) a pressure block (19) provided with a flexible buffer (20) opposite the buffer (8) on the elbow (3) of the base plate (1) and adjustable in relation to the elbow (3) so that the trouser legs (43) reaching down to the lower edge of the buffer (20) as well as the waistband (42) of the trousers (41) placed loosely over the two hangers (10 and 11) are clamped fast between the two buffers (8 and 20) when the hanger (10) disposed closest to the elbow (3) of the base plate (1) as well as the pressure block (19) are brought up to the elbow (3), (d) a guide frame (24), hinged to the base plate (1) between the hangers (10 and 11), whose width and height are greater than those of the hangers (10 and 11) and which may be swung from a position in the plane of the base plate (1) into a position vertical thereto and parallel to the hangers (10 and 11), and comprising a releasable adjustable tension bracket (35) which clamps the trouser length (44) hanging loosely between the hangers (10 and 11) when shifted toward the base plate (1).

2. Clamping device according to claim 1, characterized in that the hangers (10 and 11) comprise, respectively, two rods (12) vertical to the ground plate (1) and a round stock rod (13), respectively, connecting them at the top, and are movable with round stock elbows (14) parallel to the base plate (1) on the lower end of each vertical rod 12 in guide bearings (15 and 16) secured parallel to the lateral edges (17) of the base plate.

3. Clamping device according to claim 2, characterized in that the guide bearings (15) associated with the hanger (10) which is closest to the elbow (3) of the base plate (1) are of a length at least one-half the width of the base plate (1), and the guide bearings (16) associated with the other hanger (11) are of a length one-fourth to one-third the width of the base plate (1).

4. Clamping device according to claim 1, characterized in that the guide frame (24) comprises—in its upright position—two legs (25) vertical to the base plate (1) and a cross connection 26 at their upper ends, respectively, made of square tubing, that at the lower ends of the legs (25) round stock elbows (27) are provided parallel to the base plate (1) and movably guided in guide bearings (28) mounted on the base plate (1) and having a length of at least one-half the width of the base plate (1), that oblong holes or through slots (32) are provided on the outer and on the inner sides (29 and 30, respectively) of the legs (25), and that the cross connection (26) is shaped of two spaced-apart U-profiles forming a passing oblong slot (33).

5. Clamping device according to claim 1, characterized in that the pressure block (19) is secured to two locking mechanisms (21) adjustably guided in relation to the elbow (3) of the base plate (1) on a rail (22) which is parallel to the side edges (17) of the base plate (1) and mounted on the latter.

6. Clamping device according to claim 1, characterized in that the tension bracket (35) with two bars (36 and 37) parallel to the base plate (1) is trapeze-shaped, the side bars (38) being inwardly inclined at an angle of about 60°, that the diameter of the bars (36, 37, 38) is smaller than the width of the oblong slots (33) in the cross connection (26) of the guide frame (24), that the upper bar (36), centrally divided, comprises at the inner end of each half two downwardly shaped grips (39) disposed at a distance x from each other, and is wider by $=x/2$ on each side than the outer width of the frame (24), and that the lower bar (37) has a length resulting from the size of the inner width between the legs (25) of the frame (24) plus twice the thickness of the material of which the legs (25) are made.

7. Clamping device according to claim 6, characterized in that the lower bar (37) of the tension bracket (35)

comprises at both ends disk-like or spheroidal extensions (40) whose diameter is larger than that of the slots (32) in the legs (25) of the guide frame (24).

8. Clamping device according to claim 6, characterized in that the oblong slots (33) in the cross connection (26) of the guide frame (24) comprises recesses (34) at its lateral ends corresponding to the extensions (40) of the lower bar (37) of the tension bracket (35).

9. Clamping device according to claim 1, characterized in that the tension bracket (25) comprises merely a rod which can be tightened by means of straps held in loops disposed in the base plate (1).

10. Clamping device according to claim 1, characterized in that the base plate (1) may be suspended in and removed from the inner bottom (5) of a suitcase (6) by an unhinging hinge (4), and that the width of the base plate (1) is slightly smaller than the available depth of the bottom (7) of the suitcase, and its length is selected to correspond to the waist measurement of a folded pair of trousers (41).

11. Clamping device according to claim 10, characterized in that the base plate (1), after having been swung out of the inside of the suitcase, and with the lid (7) lifted up, is supported in its horizontal position by at least one hinged leg (9).

12. Clamping device according to claim 1, characterized in that a spacer (45) is mounted respectively to the right and left on the hanger (11) farthest removed from the elbow (3) of the base plate (1) and points in the direction of the pressure block (19).

* * * * *